US012042712B1

(12) United States Patent
McVey et al.

(10) Patent No.: US 12,042,712 B1
(45) Date of Patent: Jul. 23, 2024

(54) FITNESS EQUIPMENT STORAGE SYSTEM

(71) Applicants: Bryan McVey, Boulder, CO (US); Ray Burke, Chicago, IL (US); Tessa Brinkman, Seattle, WA (US); Erik Didriksen, Chicago, IL (US); Nicole De La Cruz, Chicago, IL (US)

(72) Inventors: Bryan McVey, Boulder, CO (US); Ray Burke, Chicago, IL (US); Tessa Brinkman, Seattle, WA (US); Erik Didriksen, Chicago, IL (US); Nicole De La Cruz, Chicago, IL (US)

( * ) Notice: Subject to any disclaimer, the term of this patent is extended or adjusted under 35 U.S.C. 154(b) by 0 days.

(21) Appl. No.: 17/977,278

(22) Filed: Oct. 31, 2022

Related U.S. Application Data

(60) Provisional application No. 63/238,983, filed on Aug. 31, 2021.

(51) Int. Cl.

| | |
|---|---|
| ***A63B 71/00*** | (2006.01) |
| ***A47B 81/00*** | (2006.01) |
| ***A47B 96/20*** | (2006.01) |
| ***B62B 3/00*** | (2006.01) |
| *A47B 88/41* | (2017.01) |

(52) U.S. Cl.
CPC ..... *A63B 71/0036* (2013.01); *A47B 81/00* (2013.01); *A47B 96/20* (2013.01); *A47B 88/41* (2017.01)

(58) Field of Classification Search
CPC ..... A63B 71/0036; A63B 2071/025; A47B 81/00; A47B 96/20; A47B 88/41; A47B 88/42; A47B 2088/421; A47B 46/00; B62B 3/005
See application file for complete search history.

(56) References Cited

U.S. PATENT DOCUMENTS

| | | | | |
|---|---|---|---|---|
| 3,628,807 | A * | 12/1971 | Fullington | A47F 5/135 211/128.1 |
| 10,869,550 | B2 * | 12/2020 | Ding Yik Ming | A47C 7/626 |
| 2004/0100173 | A1 * | 5/2004 | Jakob-Bamberg | A47B 88/42 312/330.1 |
| 2018/0056162 | A1 * | 3/2018 | Hollist | A63B 71/0622 |
| 2019/0281978 | A1 * | 9/2019 | Bowers | A47B 43/00 |

FOREIGN PATENT DOCUMENTS

JP 2003013651 A * 1/2003

* cited by examiner

*Primary Examiner* — Kimberley S Wright
(74) *Attorney, Agent, or Firm* — Plager Schack LLP; Mark H. Plager; Naomi Mann

(57) ABSTRACT

Disclosed is an exercise equipment storage device, comprising an outer shell and an inner storage assembly configured for storing and organizing fitness equipment, wherein the inner storage assembly is configured to conceal within a hollow interior of the outer shell, wherein the inner storage assembly is further configured to be removed from the outer shell, and wherein the inner storage assembly is a standalone unit when removed from the outer shell.

12 Claims, 4 Drawing Sheets

FITNESS EQUIPMENT STORAGE SYSTEM

RELATED APPLICATION

This application claims benefit to U.S. Provisional Application No. 63/238,983 filed on Aug. 31, 2021, which is incorporated by reference herein in its entirety.

BACKGROUND

The present disclosure relates generally to storage systems. More particularly, the present disclosure relates to systems for storage of fitness equipment and the like.

Keeping fitness equipment at home may be inconvenient and impractical particularly where space may be limited. As such, an improved system for storage of fitness equipment is desirable.

SUMMARY

An exercise equipment storage device according to an embodiment of the present disclosure may comprise an outer shell, and an inner storage assembly that is configured to fit inside of the outer shell and to store and organize fitness equipment. In some embodiments, the inner storage assembly is removable from the outer shell and provides a stand-alone unit when removed from the outer shell. In some embodiments, the inner storage assembly may include a front panel that is complementarily shaped to the outer shell.

An inner storage assembly according to another embodiment of the present disclosure for use with a fitness storage unit may comprise a frame, a front panel attached to the frame, a first storage platform attached to the frame, and wheels attached to the frame. The front panel may extend above the frame, below the frame, laterally beyond the frame on a first side, and laterally beyond the frame on a second side.

A repair or replacement kit for a fitness storage unit according to yet another embodiment of the present disclosure may comprise an outer shell defining a height, a width, and a length. Overall sizes and ratios of sizes will follow general guidelines such as XS, S, M, L, XL.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
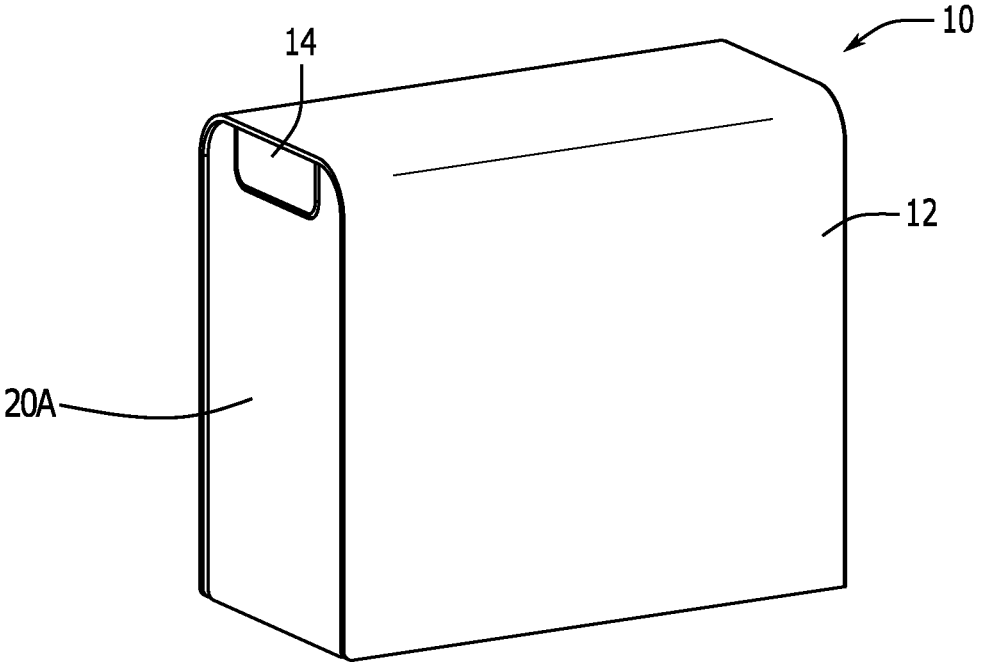
FIG. 1 is a perspective exterior view of an equipment storage device, in accordance with various embodiments.
Figure 2:
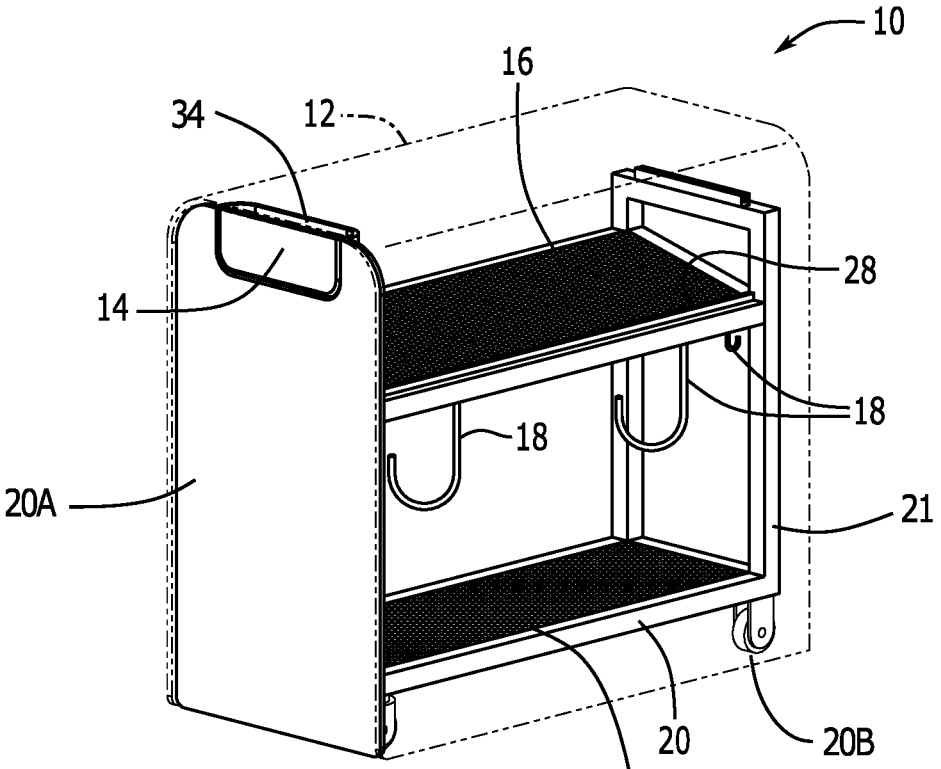
FIG. 2 is a perspective interior view of the equipment storage device.
Figure 3:
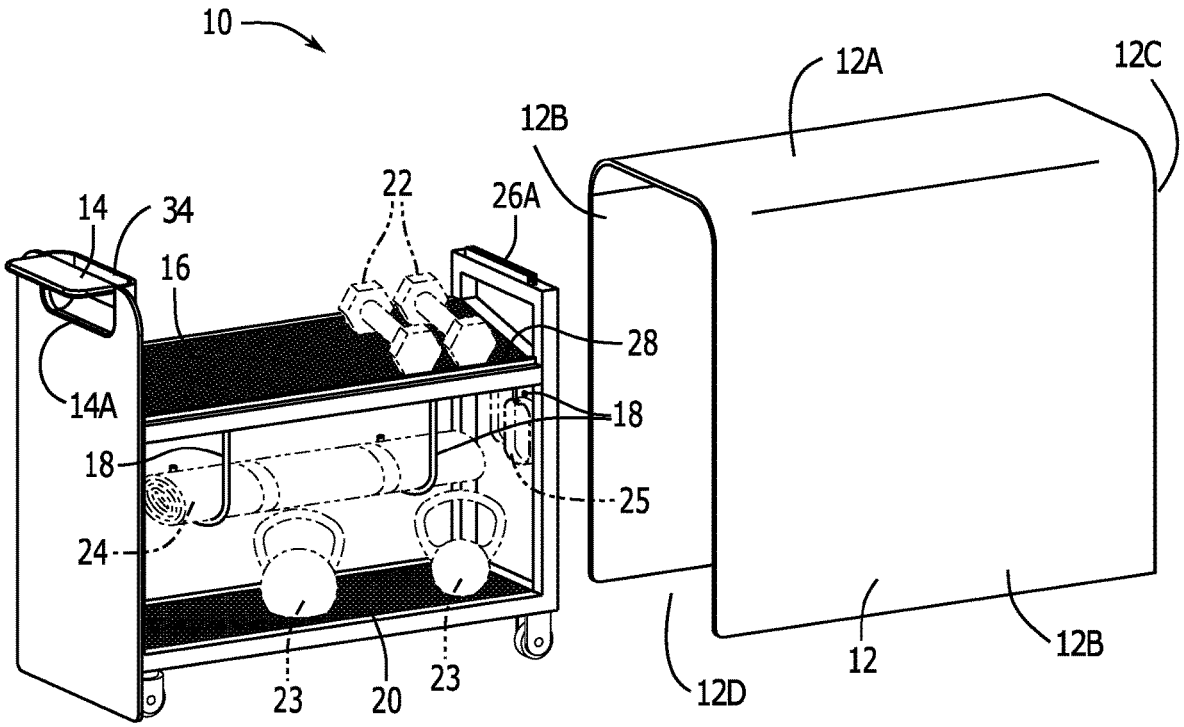
FIG. 3 is an exploded perspective view of the equipment storage device.
Figure 4:
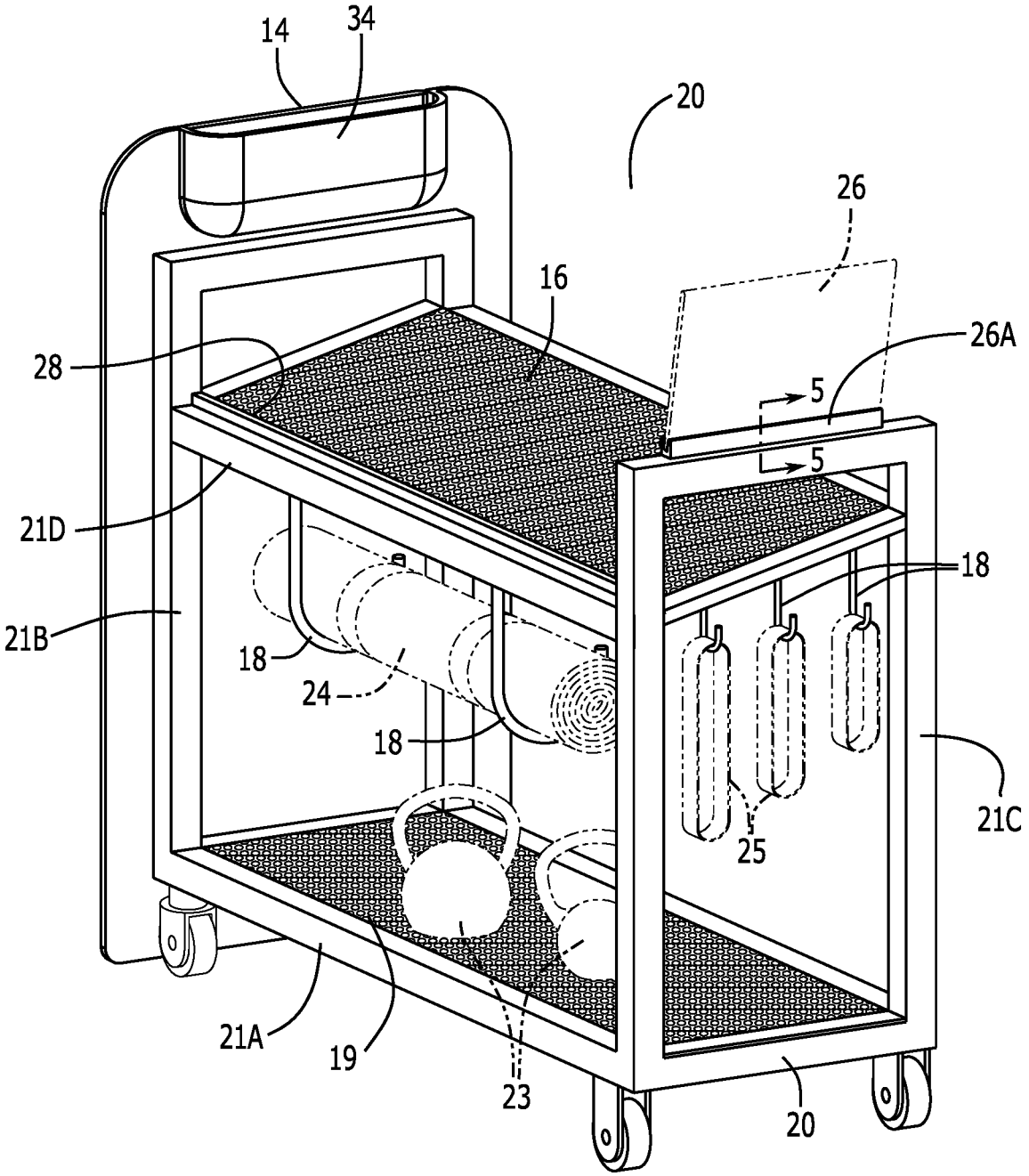
FIG. 4 is a perspective view of the equipment storage device in accordance with a second configuration.

The disclosed subject matter provides a storage solution system for fitness equipment that compactly stores and organizes fitness equipment in a living space. In certain embodiments, the system provides a storage device which may seamlessly integrate with the furnishings of the living space, allowing for convenient storage of the equipment in an unobtrusive and discrete manner.

According to various embodiments as depicted in FIGS. 1-6, disclosed is an equipment storage device 10 comprising an outer shell 12 and an inner storage assembly 20. In certain embodiments, outer shell 12 is sometime entirely visible, while inner storage assembly 20 is only fully visible when pulled out from the outer shell. Together, outer shell 12 and an inner storage assembly 20 provide a system for hiding, storing, and organizing fitness equipment. In some embodiments, equipment storage device 10 may be designed to aesthetically integrate with the furnishings and/or decor of a living space such as a living room.

In certain embodiments, outer shell 12 may include a hollow interior configured to contain and conceal inner storage assembly 20 when equipment storage device 10 is stored. Outer shell 12 may be designed to be aesthetically pleasing and seamlessly blend fitness equipment into a variety of room décors. In one embodiment, outer shell 12 may have a U-shaped profile and include a top panel 12A, and a pair of opposing side panels 12B extending downwardly from opposite sides of the top panel. In further embodiments, outer shell 12 may also include a back pane 12C integrated continuously between rear edges of the top panel 12A and side panels 12B. In further embodiments, outer shell 12 includes a front opening 12D opposite back panel 12C. According to an exemplary embodiment, the lengthwise edges between top panel 12A and side panels 12B may be rounded for a sleek appearance. As such, equipment storage device 10 may blend into a typical living space, making it convenient, attractive, and effective. In some embodiments, the perimeter of the bottom edge of the shell may also have a rubber grip all the way around to protect floors and keep the shell from sliding. It shall be appreciated that outer shell 12 may have different design configurations in alternate embodiments. For example, the rounded edges may have different curvatures or may be omitted in alternate embodiments. In other alternate embodiments, back panel 12C may be omitted, or a front panel may be included within outer shell 12.

According to various embodiments, inner storage assembly 20 is configured to fit inside of the outer shell 12 and is further configured to store and organize various fitness equipment. When removed from the outer shell, inner storage assembly 20 may be a stand-alone unit. In some embodiments, inner storage assembly 20 may include a main frame 21 formed from main frame rails and comprising a bottom frame section 21A, a front frame section 21B coupled proximate a front end of bottom frame section 21A, a rear frame section 21C coupled proximate a back end of bottom frame section, and a top frame section 21D coupled proximate top ends between the front and rear frame sections. In some embodiments, each frame section may comprise four rails forming a rectangular frame as shown. In some embodiments, top frame section 21D may be disposed between top and bottom ends of the front and rear frame sections. In further embodiments, top frame section 21D may be angled with respect to bottom frame section 21A as shown but is not limited to this option. In certain embodiments, inner storage assembly 20 may include various shelves, hooks, and/or other retaining devices for storage of various equipment.

In one embodiment, inner storage assembly 20 may include a first storage shelf 19 (also referred to as "bottom shelf") coupled to bottom frame section 21A. First storage shelf 19 may provide a flat platform for supporting various workout equipment and may be ideal for storage of heavier equipment (for example, kettlebells 23, as shown in the figure). In further embodiments, inner storage assembly 20 may include a second storage shelf 16 (also referred to as "top shelf") coupled to top frame section 21D. In one embodiment, second storage shelf 16 may be angled and may further include a bottom lip 28 which may provide a weight stop. In one example, second storage shelf 16 may be angled between approximately 45 degrees and approximately 5 degrees with respect to first storage shelf 19. As such, second storage shelf 16 may be ideal for storage of equipment such as weights 22 (dumbbells), as shown. It shall be appreciated that in other embodiments, second storage shelf 16 may be flat. In certain embodiments, first and second storage shelves 19, 16 may be lined with a rubber or other cushioned and/or high friction material.

In some further embodiments, hooks 18 may be coupled to a bottom side of top frame section 21D and may be used for hanging various equipment, such as for example an activity mat 24 (e.g., a rolled up yoga mat), resistance bands 25, and the like. In one embodiment, two hooks may be positioned along the side of top frame section 21D for holding a yoga mat, and three hooks may be positioned at back of the frame section organize resistance bands 25. Hooks 18 may be equally effective at storing other fitness equipment such as a jump rope(s), etc. Hooks 18 may be screwed or otherwise fastened into place. It shall be appreciated that hooks 18 may be omitted, differently configured, or differently positioned in alternate embodiments.

Figure 5:
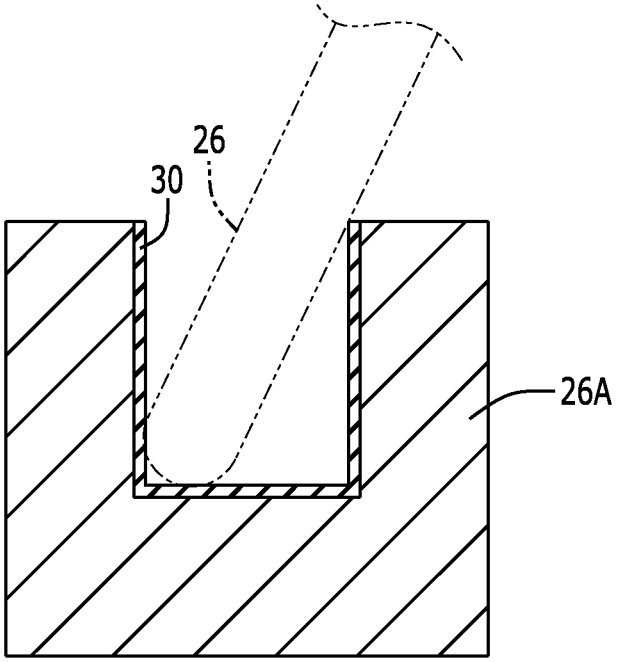
FIG. 5 is a detail cross-sectional view taken on line 5-5 of FIG. 4.
Figure 6:
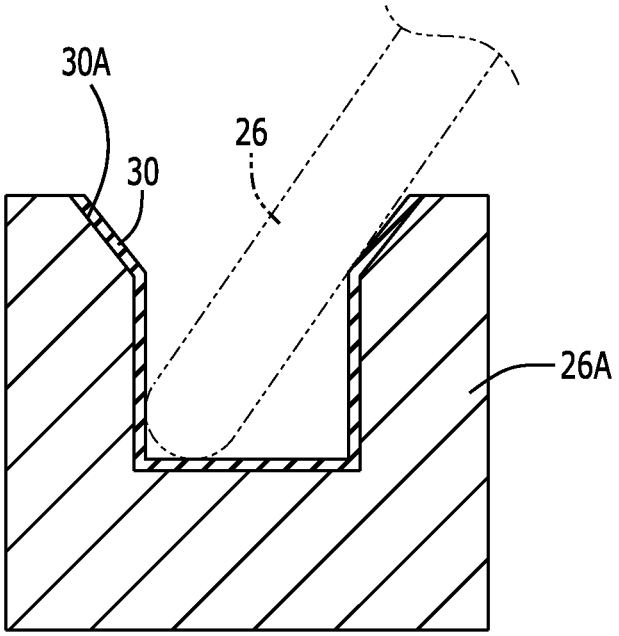
FIG. 6 is a detail cross-sectional view similar to FIG. 5, showing an alternate cross-section.

In certain embodiments, inner storage assembly 20 may include a holder 26A for an electronic device 26 such as a tablet, smartphone, etc. In some embodiments as best depicted in FIGS. 5 and 6, holder 26A may include a slot 30 configured to receive a bottom section of the electronic device and is further configured to allow the electronic device to be tipped slightly in either direction. In one embodiment, slot 30 may be lined with a protective rubber grommet. In certain embodiments, slot 30 may include angled top walls 30A as shown in FIG. 6. It shall be appreciated that other configurations of holder 26A are possible in other embodiments. In some embodiments, holder 26A may be pivotally connected, allowing it to be rotated 360 degrees to give the user freedom on where to work out and still be able to see the electronic device.

In some embodiments, holder 26A may be attached at a top side of the rear frame section. Other positions are possible in alternate embodiments such as near the front, the middle, the side, etc. Different designs are also possible in alternate embodiments; for example, holder 26A may be in the form of a shelf and/or angled stand (e.g., book stand) that enables a user to position an electronic device on inner storage assembly 20 for viewing or listening to media content during workout.

It shall be appreciated that different types of fitness equipment, electronic devices, and other items may be stored within inner storage assembly. It shall further be appreciated that that inner storage assembly may have various designs and/or may include any number and/or different types of support platforms, holders, etc., for storage of different types of items in alternate embodiments. In one embodiment, a cup or bottle holder may also be included.

In certain embodiments, inner storage assembly 20 may include a front panel 20A attached to front frame section 21B (e.g., via adhesive, mechanical fastening, welding, etc.). Front panel 20A may be complementarily shaped to outer shell 12 and corresponds to back panel 12C and/or front opening 12D. As such, front panel 20A may fit between top and side panels 12A and 12B of outer shell 12 to cover front opening 12D when inner storage assembly 20 is contained within outer shell 12.

In some further embodiments, inner storage assembly 20 may include a handle 14 within front panel 20A. In certain embodiments, handle 14 may be pivotally coupled within a handle cutout 14A provided within front panel 20A. In further embodiments, handle 14 may be rotatable between a stored configuration and a functional configuration with respect to front panel 20A. In the stored configuration, handle 14 may reside within handle cutout 14A in parallel alignment to front panel 20A (see FIGS. 1 and 2). In some embodiments, handle 14 may be configured to fully cover cutout 14A; in other embodiments, a gap may be left between handle 14 and cutout 14A in the closed stored configuration. As such, handle 14 may hide away by lying substantially flush with the front panel when not in use for maximum aesthetic appeal. In the functional configuration, handle 14 may rotate out of handle cutout 14A to provide a functional handgrip member that facilitates a user in pulling inner storage assembly 20. In certain embodiments, handle 14 may also provide a flat small shelf when rotated out to a perpendicular alignment with front panel 20, and may be used for support of small items such as keys, cellphones, and the like. In certain embodiments, handle 14 may be rotated out by pushing above its pivot point (established by a pinned connection between the handle and the front panel), and/or by grabbing underneath the handle in case the handle is spaced away from the corresponding bottom edge of the cutout 14A.

In some further embodiments, front panel 20A may include a rear pocket member 34. In one embodiment, rear pocket member 34 may be disposed proximate a top of front panel 20A, and may be used to store small items such as earbuds, pens, keys, cellphones, etc. In some embodiments, rear pocket member 34 may be formed against cutout 14A, such that handle 14 may form a front panel of pocket member 34 when handle 14 is in the stored configuration.

Additionally, inner storage assembly 20 may be in the form of a cart, including bottom wheels 20B (e.g., caster wheels) coupled to a bottom side of main frame 21 and/or bottom frame section 21A. In one embodiment, inner storage assembly 20 may include four bottom wheels. According to various embodiments, bottom wheels 20B may be attached to the frame via welding, fastening, etc. Bottom wheels 20B allow inner storage assembly 20 to be easily trans-ported in and out of shell 12 and/or to various locations. In some embodiments, bottom wheels 20B may be designed to move over both hard and carpeted floors without damaging them. These wheels may also be locked in place for extra security on uneven surfaces. As such, handle 14 and wheels 20B are configured to permit a user to easily wheel inner storage assembly 12. It shall be appreciated that bottom wheels 20B may be omitted in alternate embodiments, and that various floor engagement components, e.g., a pair of skids, etc., may be employed in alternate embodiments.

It shall be appreciated that equipment storage device may have different designs in alternate embodiments. In one embodiment, outer shell 12 and front panel 20A may have the same exterior finish, but not necessarily so. For example, both outer shell 12 and the front panel 20A may have an exterior finish that includes a wood pattern. In such a case, the exterior finish may include a brown color.

According to an exemplary embodiment, outer shell 12 may be approximately 25 inches in height and approximately 14 inches in width, the width being the distance between the pair of opposing side panels 12B. Inner storage assembly 20 may be approximately 19 inches to approximately 20 inches in height, and approximately 28 inches in length, the length being the distance between front frame section 21B and rear frame section 21C. In one embodiment, the front panel 20A may have a height to width ratio from about 1.64 to about 1.8. Furthermore, the front panel may have a convex radius of curvature and a ratio of the width to the convex radius of curvature may range from about 5.53 to about 6.70. Outer shell 12 may have a height to width ratio of from about 1.61 to about 1.95, and/or a length to height ratio of about 1.03 to about 1.25. It shall be appreciated that various sizes and dimensions may be employed in alternate embodiments.

In some embodiments, outer shell 12 and/or inner storage assembly 20 may made from sheet metal (e.g., may be about 0.3 inches thick) which enables the product to be flat packed and shipped directly to consumer's home. The formed sheet metal may ensure that sufficient strength and sturdiness is provided and may allow for a variety of laminate finishes to be applied, enabling a wide range of aesthetic designs to fit any home décor. Other materials including but not limited to wood paneling and thermoplastics may be employed, etc. As such, equipment storage device 10 may be made of multiple components that can be easily self-assembled by the consumer at home.

In certain embodiments, inner storage assembly 20 may be configured to hold up to 400 pounds of fitness equipment. Exemplary equipment includes a rack of dumbbells, a yoga mat, resistance bands, and a variety of larger items such as kettlebells and yoga blocks. In some embodiments, dumbbells may rest on an angled top shelf. This positioning may maximize the ef-fectiveness of the user's workout by emulating the design of a standard dumbbell rack and its' ergonomically designed dumbbell positioning, allowing the user to easily pick the dumbbells up and place them back down.

Equipment storage device 10 may be stationary without intentional movement by the user, which enables it to be multipurposed for other uses such as a side table for a couch or as a stand for house plants or other unique materials and objects to sit atop. According to various embodiments, equipment storage device 10 can also serve as an accent piece that stands on its own.

The dimensions of the inner storage assembly may have a relatively low profile, and a sturdy frame to aid in tip-resistance. Both the shell and inner assembly may be mainly fab-ricated from sheet steel at a common gauge, with parts nested to minimize cost with as little drop as possible. All parts may be powder coated with proper masking to complete lamination.

It shall be appreciated that the components of equipment storage device 10 described herein may be manufactured and assembled using any known techniques in the field. In certain embodiments, main frame 21/inner storage assembly 20 may comprise tubing such as rectangular annular tubing made by dual sections of C channeling which are then riveted together. This may be more cost effective than using stock tubing which is heavier and more costly. This fabrication strategy allows the use of a single gauge of sheet metal for all metal parts. In some embodiments, the first and second shelves may be laser cut and formed from stock perforated sheet steel to also minimize drop.

Any of the ranges of ratios, dimensions, etc. discussed specifically herein may be different than what has been set forth for other embodiments of the present disclosure. Similarly, the configurations of various features and materials used may vary than what has been specifically recited herein in other embodiments of the present disclosure.

As used herein, the articles "a" and "an" are intended to include one or more items and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be appreciated that the foregoing description provides examples of the disclosed assembly and technique. However, it is contemplated that other implementations of the disclosure may differ in detail from the foregoing examples. All references to the disclosure or examples thereof are intended to reference the example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

It will be apparent to those skilled in the art that various modifications and variations can be made to the embodiments of the apparatus and methods of assembly as discussed herein without departing from the scope or spirit of the disclosure(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

It shall be appreciated that the disclosed equipment storage device 10 may be used for storage of other objects in alternate embodiments. It shall be appreciated that the disclosed storage device can have multiple configurations in different embodiments. It shall be appreciated that the components of equipment storage device 10 described in several embodiments herein may comprise any alternative known materials in the field and be of any size and/or dimensions.

Furthermore, the components of equipment storage device 10 may be provided as an assembled and/or integral unit or may be provided as a kit/assembly of parts according to alternate embodiments. In some cases, the outer shell may be assembled by the end user while the frame of the inner storage assembly may be suppled intact and the user attaches the auxiliary items such as casters, hooks, etc. It is further contemplated that various components may be sold or otherwise provided as a replacement part or a substitutable item. For example, different styles or looks may be swapped out or a component such as the outer shell and/or front panel may be scuffed or damaged, necessitating repair.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An exercise equipment storage device, comprising:

an outer shell; and an inner storage assembly configured for storing and organizing fitness equipment, wherein the inner storage assembly is configured to conceal within a hollow interior of the outer shell, wherein the inner storage assembly is unattached to the outer shell and is further configured to be entirely removed from the outer shell in a normal mode of use, wherein the inner storage assembly is a stand-alone unit when removed from the outer shell, wherein the outer shell is configured to conceal exercise equipment stored within the inner storage assembly in a living space of a home environment, and to discretely integrate with the living space, where the outer shell may further serve as a support surface for objects placed on top of the outer shell, wherein the inner storage assembly includes a top shelf and a bottom shelf, wherein at least one shelf of the top shelf and the bottom shelf is configured to support and retain exercise weights, wherein the top shelve includes at least 2 hooks which extend below the top shelf and together provide a leveled support surface configured to hold a rolled-up mat above the bottom shelf, wherein the outer shell includes a top panel, a pair of opposing side panels extending downwardly from opposite sides of the top panel, a front opening defined between front edges of the top panel and opposing side panels, and a back panel integrated continuously between rear edges of the top panel and side panels, wherein the inner storage assembly includes a front panel configured to fit within the front opening of the outer shell, wherein the inner storage assembly includes a handle within the front panel, and wherein the inner storage assembly includes a holder configured to retain an electronic device.

2. The exercise equipment storage device of claim 1, wherein the top shelf includes a bottom lip configured to act as a weight stop for weights placed on the top shelf.

3. The exercise equipment storage device of claim 1, wherein the handle is pivotally coupled to the front panel and resides within a cutout of the front panel, wherein the handle is rotatable between a stored configuration and a functional configuration with respect to the front panel, wherein in the stored configuration, the handle is configured to align substantially parallel against the front panel, and wherein in the functional configuration the handle is configured to rotate out of a parallel alignment with the front panel.

4. The exercise equipment storage device of claim 1, wherein the inner storage assembly includes bottom wheels.

5. The exercise equipment storage device of claim 1, wherein the bottom wheels are caster wheels.

6. The exercise equipment storage device of claim 1, wherein the inner storage assembly includes a main frame formed from main frame rails and comprising a bottom frame section, a front frame section coupled proximate a front end of bottom frame section, a rear frame section coupled proximate a back end of bottom frame section, and a top frame section coupled proximate top ends between the front and rear frame sections, wherein the front panel is coupled to the front frame section.

7. The exercise equipment storage device of claim 6, wherein the holder is attached to a top side of the rear frame section.

8. The exercise equipment storage device of claim 7, wherein the holder includes a slot configured to receive a bottom section of the electronic device and is further configured to allow the electronic device to be tipped within the holder.

9. The exercise equipment storage device of claim 8, wherein the handle is pivotally coupled within a handle cutout provided in the front panel, and wherein the handle is rotatable between a stored configuration and a functional configuration with respect to the front panel, wherein in the stored configuration, the handle resides within handle cutout in parallel alignment to the front panel.

10. The exercise equipment storage device of claim 9, wherein the front panel includes a rear pocket member configured for storage of small items.

11. The exercise equipment storage device of claim 1, wherein lengthwise edges between the top panel and the side panels are rounded.

12. The exercise equipment storage device of claim 1, wherein the bottom shelf is leveled and wherein the top shelf is angled with respect to the bottom shelf.

* * * * *